US006146132A

United States Patent [19]

Harneit

[11] Patent Number: 6,146,132

[45] Date of Patent: Nov. 14, 2000

[54] GAS BURNER FOR OUTDOOR COOKING

[76] Inventor: Uwe Harneit, 1466 W. Francis Ave., Ontario, Calif. 91762-6016

[21] Appl. No.: 09/374,456

[22] Filed: Aug. 14, 1999

[51] Int. Cl.[7] ..... F23D 14/06

[52] U.S. Cl. ..... 431/354; 431/266; 431/286; 126/39 E; 239/552; 239/567; 239/568

[58] Field of Search ..... 431/354, 349, 431/266, 286, 350, 326, 328; 239/553.3, 553, 552, 554, 555, 558, 559, 567, 568; 126/39 R, 39 E

[56] References Cited

U.S. PATENT DOCUMENTS

| | | |
|---|---|---|
| 3,809,055 | 5/1974 | Craver . |
| 4,572,154 | 2/1986 | Schweitzer . |
| 4,960,378 | 10/1990 | Jannemann et al. . |
| 5,152,276 | 10/1992 | Brock et al. . |
| 5,195,423 | 3/1993 | Beller . |
| 5,323,759 | 6/1994 | Hammel et al. . |
| 5,468,145 | 11/1995 | Ferlin . |
| 5,558,008 | 9/1996 | Jenkins . |
| 5,623,917 | 4/1997 | Dinaso et al. . |
| 5,704,777 | 1/1998 | Measom . |
| 5,865,615 | 2/1999 | Simpson et al. . |

FOREIGN PATENT DOCUMENTS

| | | | |
|---|---|---|---|
| 000554511 | 8/1993 | European Pat. Off. | 431/286 |
| 733051 | 9/1932 | France | 239/553.3 |
| 1268511 | 6/1960 | France | 431/349 |
| 483873 | 8/1953 | Italy | 239/552 |
| 505849 | 12/1954 | Italy | 239/553 |
| 60-11012 | 1/1985 | Japan | 431/329 |
| 220037 | 6/1943 | Switzerland | 239/567 |
| 227698 | 9/1943 | Switzerland | 239/568 |
| 2193 | of 1903 | United Kingdom | 239/568 |
| 431452 | 7/1935 | United Kingdom | 239/553 |

*Primary Examiner*—Carl D. Price

[57] ABSTRACT

A multi piece gas burner assembly that is machined or cast and having a burner base that contains holes for primary air where the hole dimensions do not exceed the height of a jet mounted therein. The burner base is fastened onto an appliance. The burner head rests upon a boss on the burner base and has a tube that directs a flammable gas-air mixture from the burner base into a cavity created between the burner head and the burner cap. The burner cap rests upon the burner head and contains an outer edge that is turned downwards in order to allow fluid to drip away from the flame. A groove is cut into the burner cap just inside the down turned outer edge and provides a location for a support flame. The location of the groove prevents fluid and dust from collecting inside the groove. The groove captures the flammable gas-air mixture, which provides a constant ignition source for the gas-air mixture through slots in the burner cap when ignited.

4 Claims, 4 Drawing Sheets

GAS BURNER FOR OUTDOOR COOKING

BACKGROUND OF THE INVENTION

1. Field of the Invention

Multi-part gas burners that are used for outdoor cooking, for instance as so-called side-burners on barbeques, normally need to be dismantled and cleaned before they can be ignited after a rain. This is due to the fact that multi-part gas burners predominately have an indentation in the burner base to receive and center the so-called burner ring and rain water, and/or dirt particles collect in this indentation.

Normally these burners have a smaller flame ring underneath the main flame port openings. This smaller flame ring serves as a sort of a support flame for the main flame. This support flame prevents the main flame from being separated from the burner. Customarily the relatively small amount of gas for the support flame is conducted from the side, or from below through the walls or below the walls, from a groove going around in the burner ring resting in the burner base to the outside.

A primary disadvantage of burner designs of this sort, is that the openings for this ring of support flame, also called auxiliary gas, which goes around the outside of the burner, can become clogged with rain water or dirt particles. When the ring is clogged in this manner the normal result is that the burner cannot be re-ignited without first cleaning the openings of dirt and/or rain water. A further disadvantage with the burners currently found on today's market is that they are quite difficult to clean, since their design makes dismantling difficult if not complicated.

In burners found in today's market, the current method of supplying primary air to the burner jet which creates a flammable gas-air mixture, presents an additional problem, or requires a special technology to supply primary air. The additional problem is the size of the hole in the jet. This is a problem because, the size of the hole in the burner jet is pre-set for the maximum necessary flow of gas for the maximum burner output. The maximum flow for the maximum burner output is basically too great a gas flow for the lower settings of the burner. At present, this is unavoidable from a design standpoint, and results in the flow pressure of the lesser amount of gas for the low setting being much less than for the maximum setting. Since this gas flow jet is installed below the actual burner and is thus exposed to wind from the side, it frequently occurs that the flow of gas through the jet is displaced sideways, and the burner goes out.

In order to prevent this sideways displacement of the flow of gas from the jet, other burner designs for this reason, have provided the jet with a round, closed housing (burner base) in the lower part of the burner. By designing the burner base in this manner, the drawing of primary air now is from above the edge of the closed housing surrounding the jet and downward. Even in this type of design a side wind can cause rain water to penetrate into the housing over the upper edge. If sufficient rainwater collects, this would close the relatively small hole in the gas flow jet. The current procedure to prevent water and dirt from accumulating in the burner base is the introduction of a so-called rain-runoff opening (hole) in the base of the housing. This provides a passageway for the rainwater and dirt that normally accumulate in the burner base which is customarily closed in the base and side walls.

2. Description of the Prior Art

The use of a multi-part gas burner is known in the prior art,

Prior art U.S. Pat. No. 5,865,615 discloses an improved burner for a gas range used in the home. The basis of this invention is to provide an improved capability for the owner of this type of burner to clean the range without using special tools, as was necessary prior the to creation of the invention disclosed in this patent.

Prior art U.S. Pat. No. 5,704,777 discloses an improve gas burner for cooking in outdoors settings. The purpose of this invention is to provide improved resistance to the effects of winds that typically could cause a disruption of the flame. This invention discloses a burner screen that allows the air-fuel mixture, which is sub-stoichiometric in nature, to pass through the screen and mix with surrounding ambient air, thus creating a stoichiometric air-fuel mixture that will burn. The burner screen is protected from ambient wind currents by being installed within a burner cup, which is sub flush to the top surface of the burner cup. When a cooking pot is used on the burner, it helps to significantly reduce the effects of wind on the burner's flame.

Prior art U.S. Pat. No. 5,623,917 discloses a gas burner assembly that is easily removed and is secured to the top panel of a range by using a mounting bracket, which locks the burner assembly in place and prevents rotation of the burner assembly.

Prior art U.S. Pat. No. 5,468,145 discloses a sealed gas burner that has an improved spark ignition system that will eliminate the problem of a non-consistent spark, which increases the reliability of ignition of the air-gas mixture. An additional benefit of this invention is the protection of the igniter electrode from damage due to food spills.

Prior art U.S. Pat. No. 5,323,759 discloses a sealed gas burner mounting assembly which allows easy assembly, disassembly, and adjustment of the burners after maintenance has been performed. The patent also discloses one piece burner heads with integral gas pipes affixed onto them.

SUMMARY OF THE INVENTION

The purpose of the present invention is to provide a burner assembly that has improved resistance to dirt and moisture intrusion into the supporting flame groove of the burner assembly.

It is a further purpose of the invention to provide an improved burner assembly that can operate efficiently at low temperature settings in 10 mile per hour (MPH) winds.

Another purpose of the invention is to provide an improved burner assembly that is capable of operating in a rainy environment without extinguishing the flame.

The present invention consists of a multi-piece burner assembly which is comprised of a east, or machined burner base, which is attached to an appliance top using screws, rivets or other mechanical fastening means. The upper portion of the burner assembly which is named a burner head, consists of a cast or machined structure that provides a passage for a gas-air mixture from the burner base to the top surface of the burner head. The burner head rests on a boss integral to the burner base and is loosely attachable. The top of the burner assembly consists of a burner cap. The burner cap consists of a groove for a support flame, a lip that allows liquid to drip away from the support flame groove, a boss that provides burner ports for flame and an additional boss for the burner cap to connect with the upper portion of the burner assembly.

DETAILED DESCRIPTION

Figure 1:
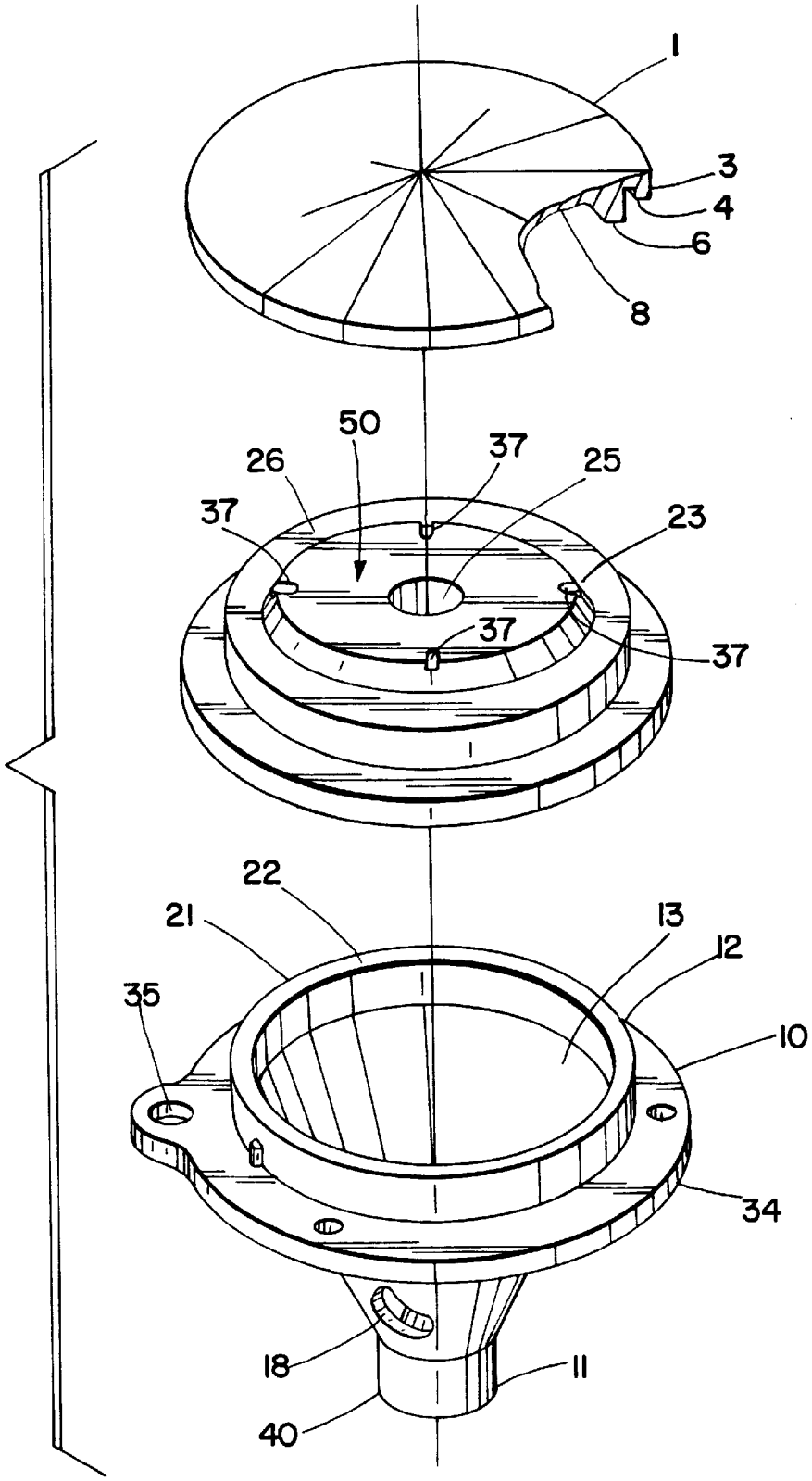
FIG. 1 shows an exploded view of the burner assembly.
Figure 2:
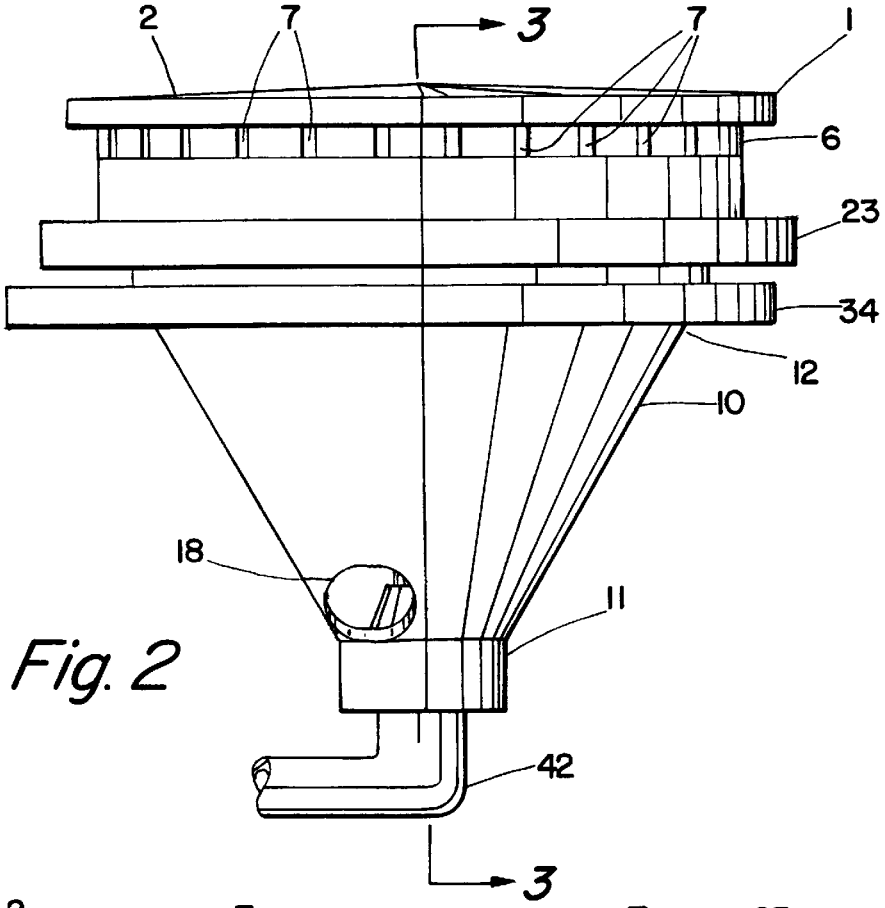
FIG. 2 is a side elevation of the burner assembly showing the burner base, the burner head and the burner cap in their respective positions.
Figure 3:
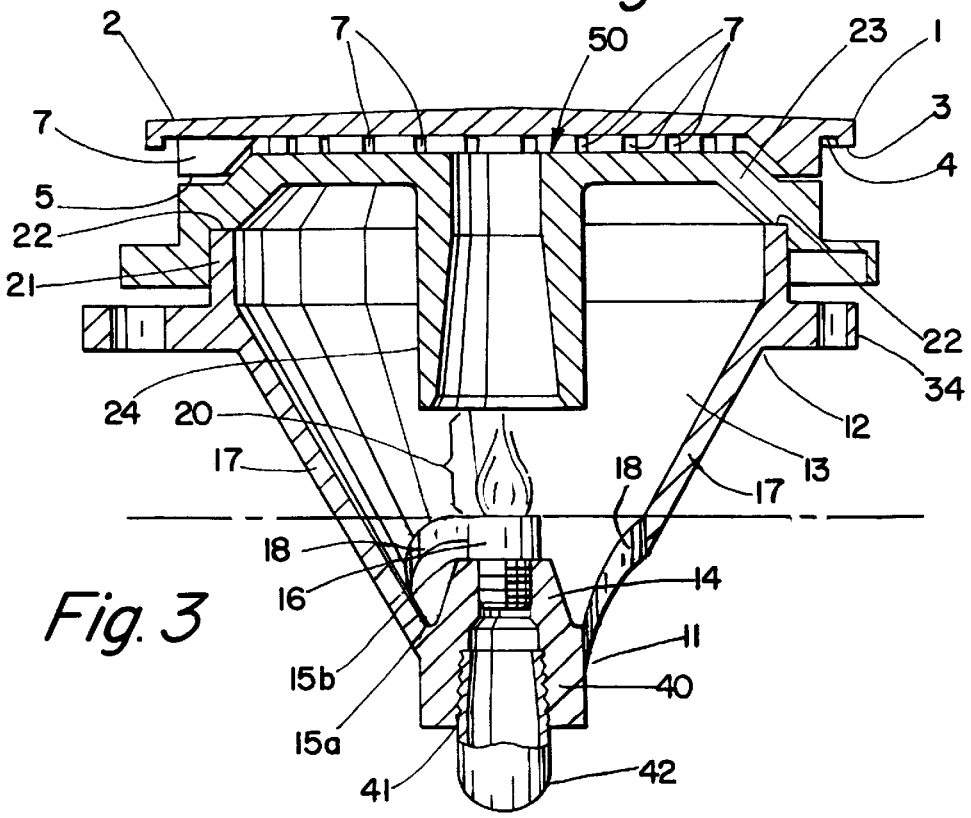
FIG. 3 is a cross section of the side elevation showing the burner base, the burner head, and the burner cap
Figure 4:
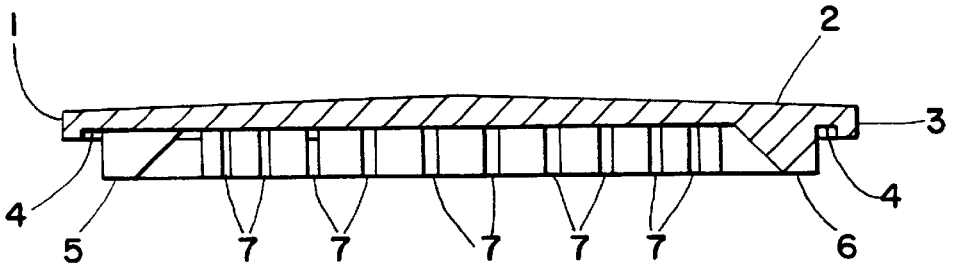
FIG. 4 depicts the burner cap in cross sectional side elevation
Figure 5:
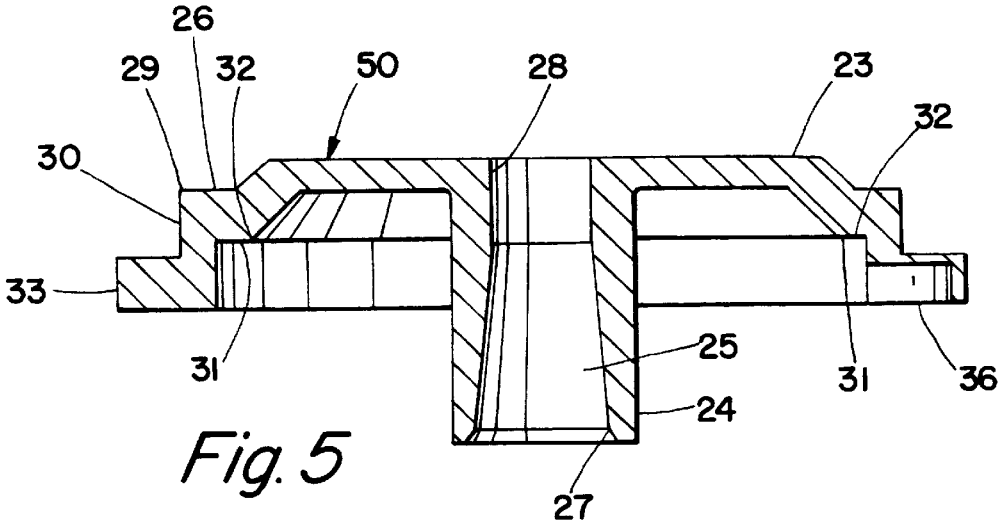
FIG. 5 depicts the burner head in cross sectional side elevation
Figure 6:
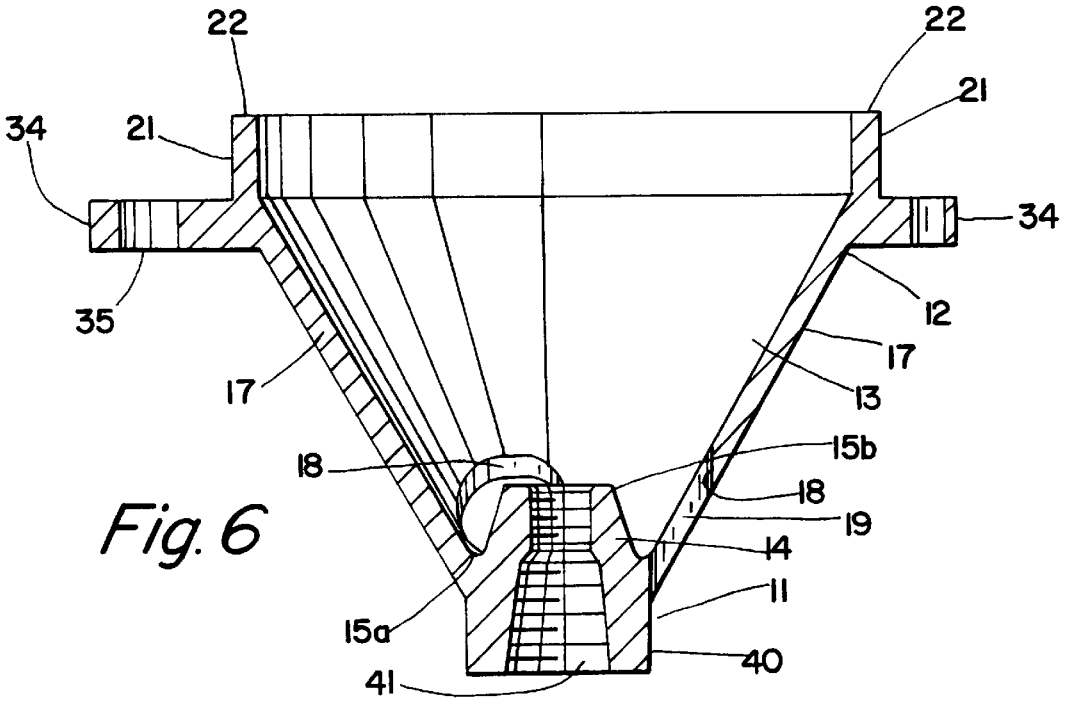
FIG. 6 depicts the burner base in cross sectional elevation.
Figure 7:
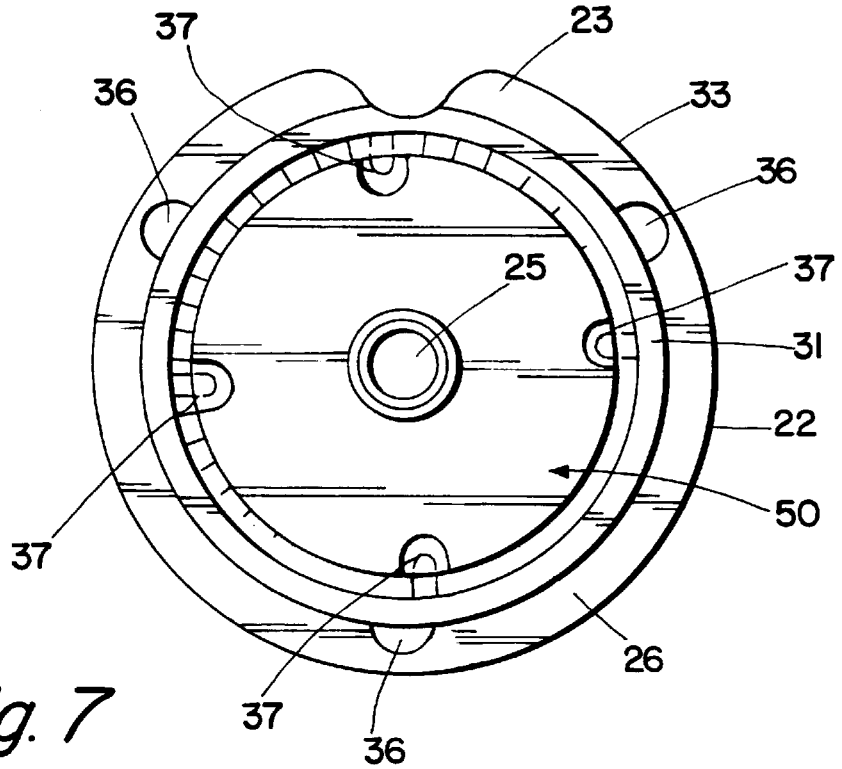
FIG. 7 is a bottom view of the burner head.
Figure 8:
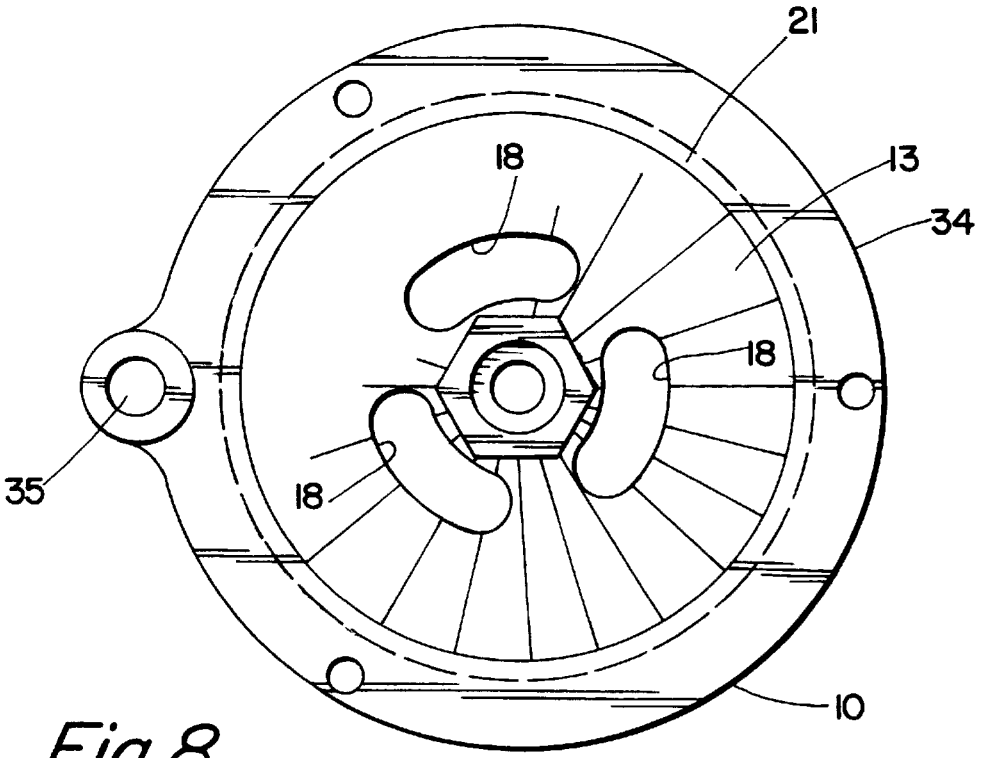
FIG. 8 is a top view of the burner base, looking into the cavity of the burner base.

The burner assembly for this invention includes a burner cap (1), that has a horizontal surface (2), wherein an outer portion of the horizontal surface (2) has a down turned flange or lip (3) that overhangs the edge of the burner cap (1). Just inside the down-turned flange edge, an annular groove (4) has been carved into the burner cap (1). This annular groove (4) has a depth that is gauged to allow enough of a gas-air mixture to be captured to provide a support flame for the burner cap (1). The burner cap (1) contains an annular ring defining a burner ring (6) that extends downwards from the burner cap (1). The burner ring (6) contains a multiplicity of holes (7) or slots that penetrate through the annular ring (6) into a gas-air chamber (8). A stoichiometrically correct gas-air mixture penetrates through the multiplicity of holes (7) and is ignited and sustained by a support flame. The multiplicity of holes (7) or slots penetrating through the burner ring (6) additionally provide enough gas-air mixture to be captured within the annular groove (4) and sustain the support flame. Integral to the burner ring (6) are a multiplicity of ears (5) that extend downwards and position the burner cap within slots (37) cut into a raised portion (50) of the top side (26) of the burner head (23).

The burner base (10) is made generally in a conical shape, which has an apex (11) and a base (12). The burner base (10) is inverted the base (12) pointing upwards and the apex (11) pointing downwards. The burner base (10) is hollow with a constant wall thickness, thus defining, a cavity (13). The apex (11) of the burner base (10) has a boss (40) that projects downwards the boss (40) having a hollow portion (41), the hollow portion (41) being internally threaded in which means for injecting flammable gas can be injected into the burner assembly. Inside the cavity (13) a hollow tube (14) having two ends is attached on one end **(15*a*) to the burnerbase and on the opposing end (15*b*) a jet (16) is installed, the hollow tube (14) being connected to the boss (40). The hollow tube (14) being coincident with the hollow portion (41) of the boss (40) thereby allowing the injected flammable gas to pass through a connector means (42), through the apex (11), into the hollow tube (14), through the jet (16) and into the cavity (13) of the burner base (10). The top of the jet (16) defines a horizontal plane and provides a high pressure stream of gaseous fuel into the cavity (13) of the burner base (10). The wall of the burner base (17) has holes (18) or slots cut vertically into the wall of the burner base (17), providing a ring shaped passage from the outer environment to the cavity (13) of the burner base (10). The size of the holes (18) in the burner (10) base are cut so as to not exceed the height of the jet (16), or the horizontal plane defined by the top surface of the jet (16), This assures that there is no direct line from an outside airstream to the jet (16). By making the dimensions of the holes (18) or slots smaller than the height of the jet (16), disruption of the flow of gas to the burner cap (1) is prevented. The holes (18) or slots provide openings, which allows primary air into the burner base (10) and mixes with the flammable gas to provide a good stoichiometric gas-air mixture. The burner base (10) has material extending outwardly from the burner base (10) creating a horizontal land (34). The horizontal land (34) provides a surface to firmly connect the burner base (10) to a chassis of an appliance, such as a grill top or range top, by fastening means such as screws, bolts, or rivets. The horizontal land (34) additionally has a hole (35) defined therein to provide a location for an ignition means for the stoichiometric gas-air mixture. The appliance has a hole defined coincident with the cavity in the conical burner base therein, thus providing a passageway from the burner base (10) below, through the appliance. The burner base (10) has an annular ring (21) that extends upward and penetrates through the appliance top, creating a land (22) in order for a burner head (23)** to rest upon.

The burner head (23) is essentially a horizontal plate that has an annular boss (24) extending downward. The annular boss (24) is centrally located above the jet (16) and is positioned away from the jet (16) defining a gap (20). The annular boss (24) has a hole (25) defined therein that extends upward and penetrates through the raised portion (50) of the top side (26) of the upper portion of the burner head (23). The hole (25) in the annular boss (24) could be cylindrical, or as in the invention here tapered, where a lower portion (27) has a hole diameter greater than a hole diameter in an upper portion (28) of the annular boss (24). The burner head (23) has an outer edge (29) wherein the outer edge (29) has an annular ring (30) that extends downward. The annular ring (30) has material removed defining a slot (31), where the slot (31) extends around the entire annular ring (30), and provides a groove (32) for the land (22) defined in the burner base (10) to rest upon. The annular ring (30) has an outer portion with material extending from the boss defining a foot (33), the foot (33) providing additional support for the burner head (23) to rest upon the burner base (10) and appliance. The foot (33) additionally having holes (36) defined therein to provide clearance to the attachment fasteners on the burner base (10).

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

I claim:

1. A burner assembly for outdoor cooking comprising:

a burner base, said burner base having an annular ring, said annular ring providing a raised edge to receive a burner head, said burner base further having an interior cavity, said burner base further having a multiplicity of slots, said slots providing passage for drawing primary air into said interior cavity of said burner base, said slots being below an upper edge of a jet, said burner base having an installation flange on said burner base for mounting said burner base onto a chassis of a cooking appliance;

said burner head having an annular slot allowing said burner head to rest loosely on said raised edge of said burner base, said burner head further having a top surface to receive a burner ring, said top surface of said burner head additionally being smooth and having no depressions in which water or dirt could collect, said burner head further having a raised portion, said raised portion having sideways slots defined upon said raised portion of said burner head; and a burner cap, said burner cap having an outer edge, said outer edge having a flange projecting downwards from said outer edge of said burner cap defining a lip, said burner ring having slots for a main flame, said burner ring being located inside and away from said lip defining a groove therebetween, said groove collecting a flammable gas-air mixture, said groove being above said slots in said burner ring, said flammable gas-air mixture being captured in said groove and providing gas for a supporting flame when ignited under said edge of said burner cap and above said jet, said lip additionally allowing dirt and fluid to drip away from said supporting flame preventing said supporting flame from being extinguished.

2. A burner assembly according to claim 1 wherein said burner ring, and said burner cap are separate components, said burner ring loosely fitting into said burner cap.

3. A burner assembly according to claim 1 wherein said multiplicity of slots in said burner base can be horizontal or vertical to a horizontal plane defined by said upper edge of said jet.

4. A burner assembly according to claim 1 wherein said burner ring has a multiplicity of ears said ears being positioned on said burner ring, said sideways slots located on said top surface of said burner head being positioned and allowing said ears to fit into said sideways slots in said burner head positionally locating said burner ring.

* * * * *